United States Patent [19]

Hoss

[11] Patent Number: 4,735,330

[45] Date of Patent: Apr. 5, 1988

[54] COLLAPSIBLE BIN

[75] Inventor: Donald A. Hoss, Southfield, Mich.

[73] Assignee: Chrysler Motors Corporation, Highland Park, Mich.

[21] Appl. No.: 20,310

[22] Filed: Mar. 2, 1987

[51] Int. Cl.[4] ..... B65D 21/02

[52] U.S. Cl. ..... 220/6; 220/7; 220/1.5; 220/4 F

[58] Field of Search ..... 220/7, 6, 4 F, 1.5

[56] References Cited

U.S. PATENT DOCUMENTS

| | | | |
|---|---|---|---|
| 3,981,410 | 9/1976 | Schurch | 220/1.5 X |
| 4,173,289 | 11/1979 | Nesti | 220/7 |
| 4,186,841 | 2/1980 | Buckley et al. | 220/4 F X |
| 4,339,047 | 7/1982 | Johansson et al. | 220/1.5 |
| 4,662,532 | 5/1987 | Anderson et al. | 220/6 X |

*Primary Examiner*—Steven M. Pollard

*Attorney, Agent, or Firm*—Edward A. Craig

[57] ABSTRACT

A collapsible bin comprising a generally rectangular bottom wall and four side walls is provided. The bottom wall has an upstanding U-shaped support element at each corner thereof. The side walls are arranged into first and second pairs. Each pair of side walls is pivotally mounted and supported by the U-shaped support elements. The side walls are collapsible from an upright position to a position on the bottom wall to provide a storage configuration of relatively small size. Latch means are provided to secure the side walls in an upright position.

1 Claim, 3 Drawing Sheets

COLLAPSIBLE BIN

BACKGROUND OF THE INVENTION

1. Field of the Invention

This invention relates to a collapsible bin construction having an erected configuration and a storage configuration. The bin construction includes a bottom wall and four collapsible side walls.

2. Prior Art

In modern manufacturing, it is common practice to assemble completed units at a single location from various parts and components which are shipped to the assembly location from other locations. The parts and components are normally fabricated in facilities remote from the assembly location and shipped to the assembly location in containers. Two problems have arisen in connection with the use of prior art containers. One type of container which has been in common use in the past is the throw-away containers. Such containers are fabricated of such materials as cardboard and low grade wood. Throw away containers have presented a serious disposal problem at assembly plants. Additionally, such throw away containers are not available in units of sufficient strength to ship heavy parts and components.

Reusable bins fabricated of corrugated steel have been in common use in the past. Such bins are strong in construction and are capable of retaining heavy parts and components. Such reusable containers have had the disadvantage of being expensive to transport empty back from an assembly location to the location of the origin of parts and components for refilling and reshipment. Collapsible containers have been suggested. However, such collapsible containers have suffered from a low return ratio. The return ratio is the ratio between a fully erected container and a collapsed and stored container. For example, it has been common in the past for one erected container to equal three collapsed containers. In accordance with the present invention a collapsible bin is provided which has substantially a higher return ratio, the return ratio being approximately 3.95 to 1.

SUMMARY OF THE INVENTION

The collapsible bin comprises a generally rectangular bottom wall with four side walls. The bottom wall has a U-shaped bottom element at each corner thereof. Each support element comprises an upstanding back panel with spaced apart upstanding side panels extending from the upstanding edges thereof to define the aforesaid U-shape. Each U-shaped support element has a mouth providing access to the interior thereof. The support elements are arranged in two pairs. Each pair comprises two support elements on adjacent corners of the bottom wall. The mouths of the support elements of each pair face each other.

The side walls are arranged into first and second pairs. The first pair of side walls comprises two oppositely disposed side walls which face each other and each of which extends between one of the pairs of support elements and is pivotally connected at the lower portion thereto. Each side wall of the first pair is adapted to be directly pivoted from an upright position to a collapsed position over the bottom wall.

The second pair of side walls comprises the remaining two oppositely disposed side walls which face each other and each of which extends between adjacent support elements of different pairs and is pivotally connected at the lower portion thereto. Each side wall of the second pair has a downwardly extending rail at each lower corner thereof. The rails are received within the U-shaped support elements. Each rail has a slot opening means therein. A pin structure is secured within each of the U-shaped support elements and extends into the slot opening means of each associated rail to pivotally and slidably mount the rail. The slot opening means of each rail is angled upwardly and inwardly of the bin. Each side wall of the second pair is adapted to be pivoted from an upright position to a collapsed position over the bottom wall by first lifting the side wall upwardly whereupon it will slide on the pin structure and move inwardly of the bin and then pivoting it to the collapsed position over the bottom wall. The inward movement of the side wall spaces the bottom of the rails from the back panel of the U-shaped support elements so that the bottom of the rails will clear the back panel when the side wall is pivoted and also to space the pivot point of the side walls of the second pair above the pivot point of each side wall of the first pair permitting the side walls of the first pair to be first collapsed onto the bottom wall and the side walls of the second pair to then be collapsed onto the side walls of the first pair.

First latching means are provided to releasably secure each side wall of the second pair to the U-shaped support elements associated therewith when the side walls of the second pair are in the upright position. Second latching means are provided to releasably secure each side wall of the first pair to the adjacent side walls of the second pair when both the side walls of the first and second pairs are in the upright position.

Each side wall of the first pair includes wall structure which extends substantially to the bottom wall. Each side wall of the second pair has wall structure which terminates short of the bottom wall. A side wall panel is provided in the space between the termination of each side wall of the second pair and the bottom wall. The side wall panels are permanently affixed between the U-shaped support elements.

One of the side panels of each U-shaped support element is positioned interiorly of the bin and the side panel of each U-shaped support element is positioned exteriorly thereof. The interior side panel is shorter than the exterior side panel to permit passage of the side walls of the first pair. The side walls of the first pair contact the exterior side panels when said side walls are in an upright position to be laterally supported thereby. Support tabs are provided on the side edges on each side wall of the second pair adjacent the upper edges thereof. Each support tab terminates in a finger directed inwardly of the bin. Each side wall of the first pair has slot means to receive the fingers when all of the side walls are in an upright position to thereby provided interrelated lateral support for all of the side walls.

The first latching means include projecting means on the rail. The side panels on the U-shaped support element have notches to receive the projecting means. The second latching means comprise a slidable latch on each upper corner of each side wall of the first pair. Catch means are provided in each upper corner of each side wall of the second pair to latchingly receive the slidable latches.

A support platform is provided within each U-shaped support element to receive the lower end of each rail of the side walls of the second pair when said side walls are in the upright position. The lower end of each rail is substantially flat. An upstanding lip is provided on the edge of the platform closest to the mouth of the U-shaped support element to prevent movement of the lower end of the rail toward said mouth.

DETAILED DESCRIPTION OF A PREFERRED EMBODIMENT

Figure 1:
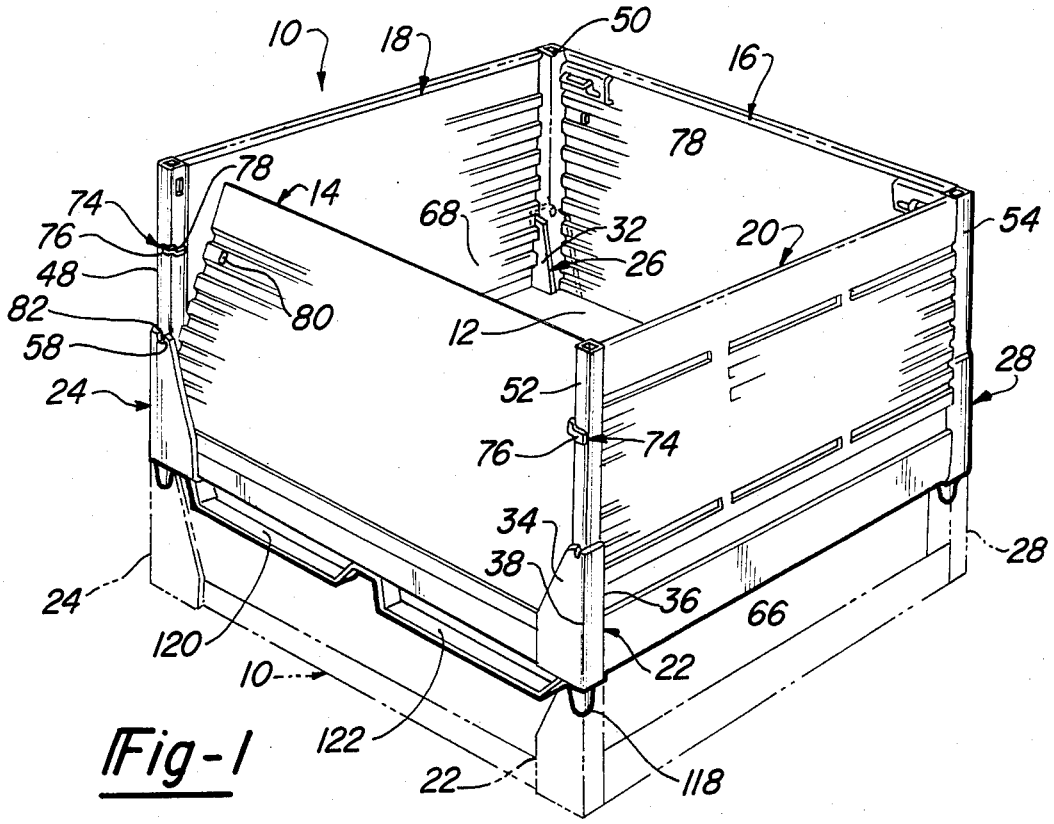
FIG. 1 is a view in perspective of one embodiment of the collapsible bin in accordance with the present invention shown in the erected condition and illustratively stacked upon a bin in the collapsed condition to show how the bins may be stacked upon each other for storage purposes.
Figure 2:
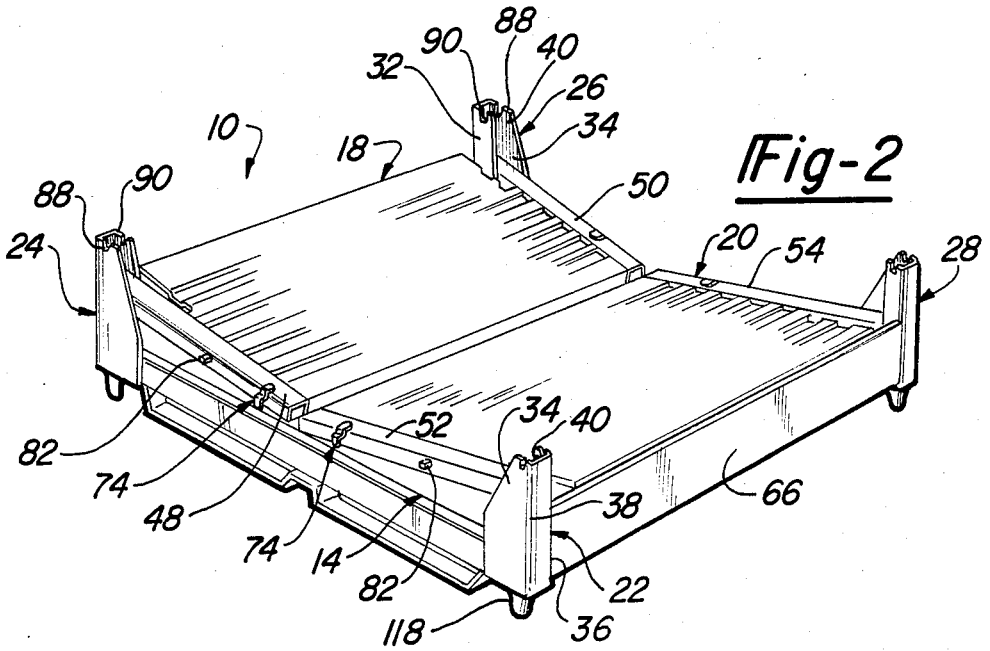
FIG. 2 is a view in perspective of the collapsible bin of FIG. 1 shown in the collapsed condition.

Referring to FIGS. 1 and 2, it will be noted that the collapsible bin 10 comprises a generally rectangular bottom wall 12 and four sidewalls 14, 16, 18, 20. The wall structures are preferably fabricated of a corrugated steel material. The bottom wall 12 has an upstanding U-shaped support element 22, 24, 26, 28 at each corner thereof. Each support element comprises an upstanding back panel 30 with spaced apart upstanding side panels 32, 34 extending from the upstanding edges 36, 38 thereof to define the aforesaid U-shape. Each U-shape support element has a mouth 40 providing access to the interior thereof. The support elements are arranged in two pairs 22, 24 and 26, 28. Each pair 22, 24 and 26, 28 comprises a support element on adjacent corners of the bottom wall 12. The mouths of the support elements of each pair 22, 24, and 26, 28 face each other.

The side walls are also arranged into first and second pairs 14, 16 and 18, 20. The first pair of side walls 14, 16 comprise oppositely disposed sidewalls which face each other and each of which extends between one of the pairs 22, 24 and 26, 28 of U-shaped support elements and is pivotally connected at the lower portion thereto. As will be noted in FIGS. 3 and 4, the pivotal connection comprises a rod 42 one of which is secured to each lower corner portion of each side wall 14, 16. The rod 42 extends through opening means 43 provided in the lower portion 45 of each U-shaped support element which serves as a bearing structure. Each side wall 14, 16 of the first pair is adapted to be directly pivoted from an upright position as shown in FIG. 1 to a collapsed position over the bottom wall 12 as shown in FIG. 2.

Figure 3:
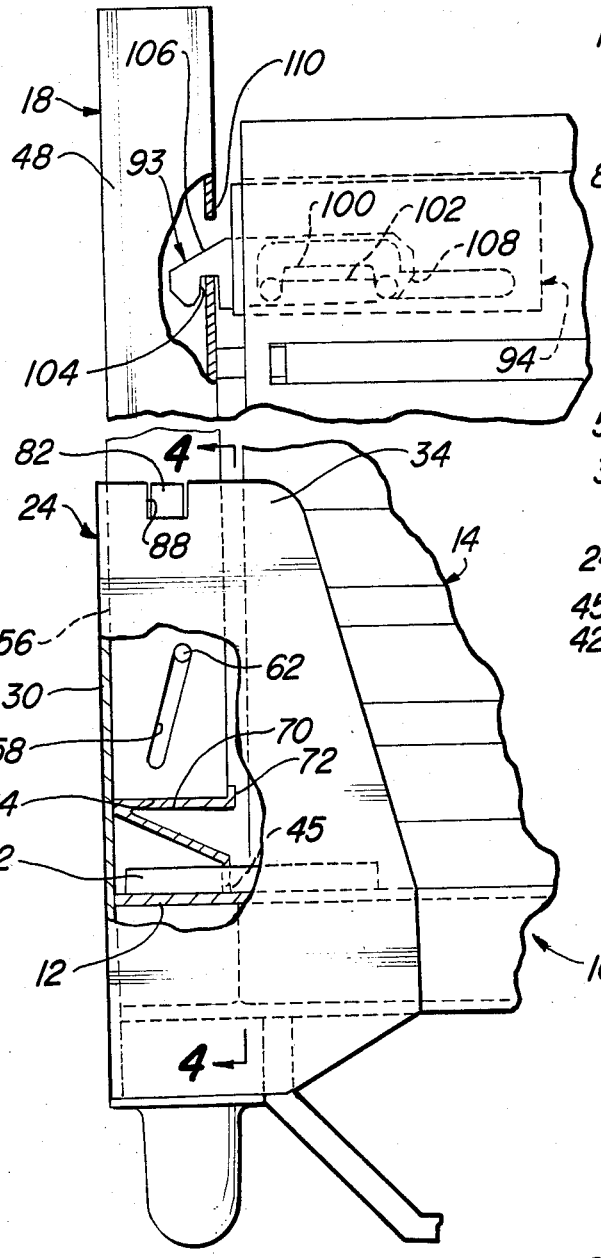
FIG. 3 is an elevational view of a corner portion of the collapsible bin with portions removed for the purpose of clarity.
Figure 4:
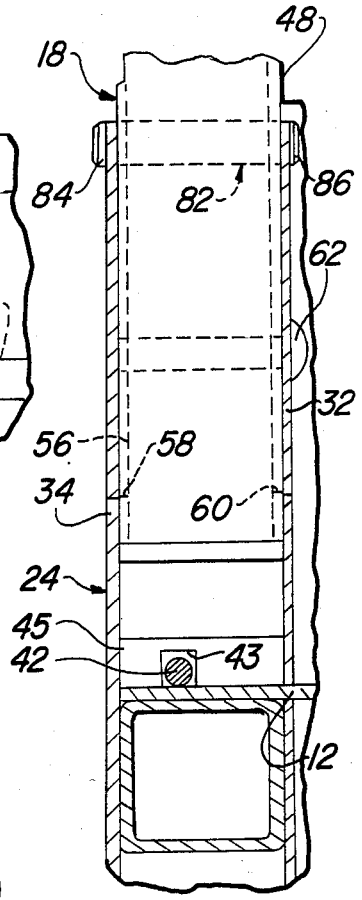
FIG. 4 is a sectional view taken substantially along the line 4—4 of FIG. 3 looking in the direction of the arrows.
Figure 6:
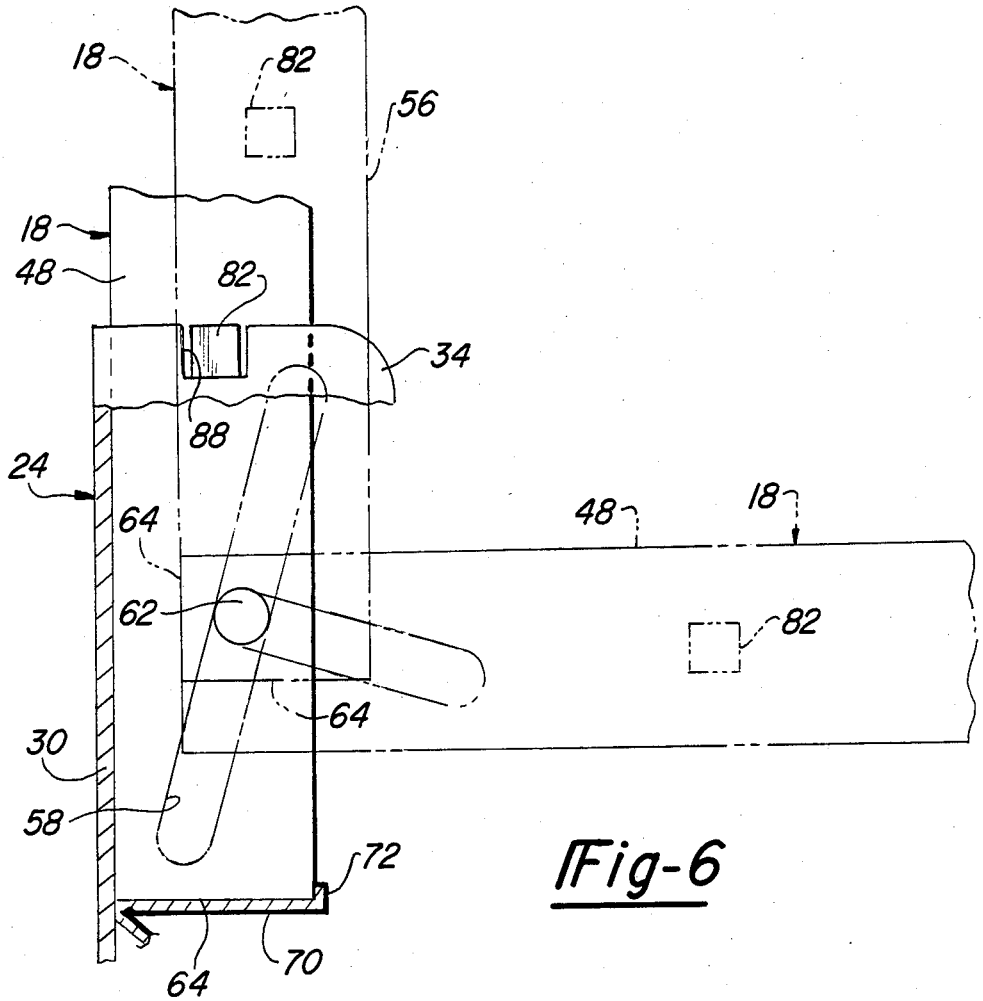
FIG. 6 is an enlarged view of a portion of the structure shown in FIG. 3 with the side wall shown in three positions illustrating operation of the structure for moving the side wall into an upright position or into a collapsed position.

The second pair of side walls 18, 20 comprises the remaining oppositely disposed side walls which face each other and each of which extends between adjacent support elements 22, 26 and 24, 28 of different pairs and is pivotally and slidably connected at the lower portion thereto. Each side wall 18, 20 of the second pair is constructed with end rails 48, 50, 52, 54 between which extend corrugated wall portions. The rails are in the form of square tubular members. Each rail has a downwardly extending rail portion which is free of wall structure at the lower end thereof. Downwardly extending rail portion 56 of rail 48 is illustrated in FIGS. 3, 4 and 6. These rail portions are received within the U-shaped support elements 22, 24, 26, 28. Each rail portion has a slot opening means therein. The slot opening means takes the form of a pair of slots 58, 60, one provided in each opposed wall of the rail portion.

A pin structure in the form of an unthreaded bolt 62 is secured within each of the U-shaped support elements as by welding. The bolt 62 extends through the slots 58, 60 of each associated rail to pivotally and slidably mount the rails. As will be noted, these slots are angled upwardly and inwardly of the bin 10. When the side walls 18, 20 are in the upright position the bolt 62 is positioned at the upper end at the slots with the weight of the side walls bearing thereon. Each side wall 18, 20 of the second pair is adapted to be pivoted from the upright position shown in FIGS. 1, 3 and 6 to a collapsed position over the bottom wall as shown in FIGS. 2 and 6. This is accomplished by first lifting the side wall upwardly as shown in FIG. 6 whereupon it will slide on the bolt 62 and move inwardly of the bin as shown in dotted lines in FIG. 6. The side wall is then pivoted to the collapsed position also as shown in dotted lines in FIG. 6. The inward movement of the side wall spaces the bottom 64 of the rail from the back panel 30 of the U-shaped support element so that the bottom of the rail will clear the back panel when the side wall is pivoted. This movement also spaces the pivot point of the side walls 18, 20 of the second pair further above the pivot point, represented by the rods 42, of each side wall 14, 16 of the first pair permitting the side walls of the first pair to be first collapsed onto the bottom wall 12 and the side walls 18, 20 of the second pair to then be collapsed onto the side walls of the first pair as shown in FIG. 2. Absent such spacing, it would not be possible for the side walls of the second pair to lie in the configuration shown.

As will be noted in FIGS. 1 and 3, each side wall 14, 16 of the first pair includes wall structure which extends substantially to the bottom wall 12. This is possible because the side walls 14, 16 are pivotally mounted adjacent the bottom wall 12. However, the fact that the rails 48, 50, 52, 54 of the side walls 18, 20 of the second pair are received in U-shaped support members 22, 24, 26, 28 prevents attaching wall stucture thereto and requires terminating the side wall structure thereof short of the bottom wall 12. A side wall panel 66, 68 is provided in the space between the termination of each side wall 18, 20 and the bottom wall 12. The side wall panels 66, 68 are permanently affixed between the U-shaped support elements 24, 28 and 22, 26.

A support platform 70, as shown in FIGS. 3 and 4, is provided within each U-shaped support element to receive the lower end 64 of each rail of the side walls 18, 20 when the side walls are in the upright position. These lower ends are substantially flat in order to distribute the weight of the side walls 18, 20. An upstanding lip 72 is provided on the side edge of the platform 70, this edge being the one closest to the mouth of the U-shaped support element. The lip 72 prevents movement of the lower end of the rail towards the mouth and thus stabilizes the upright position of the side walls 18, 20.

The U-shaped support elements 22, 24, 26, 28 are configured so as to permit collapsing of the side walls 14, 16 of the first pair inwardly while at the same time providing lateral support in the outward direction to make the side walls strong enough in the erected condition to withstand the internal loading of the bin. As will be noted in FIG. 2, the side panel 32 of each U-shaped support element is positioned interiorly of the bin while the other side panel 34 is positioned exteriorly of the bin. The interior side panel 32 is shorter than the exterior side panel 34 to permit passage of side walls 14, 16 for the purpose of erection or collapsing of the bin 10. The side walls 14, 16 contact the exterior side panel 34 when the side walls are in the upright position and are thereby laterally supported.

Additional lateral support is provided by support tabs 74, one each of which is provided on each rail of the side walls 18, 20 of the second pair adjacent the upper end thereof. Each support tab comprises a first portion 76 which is secured in place as by welding. Each portion 76 terminates in a finger 78 which is directed inwardly of the bin. Each side wall 14, 16 of the first pair has slot means 80 to receive the fingers 78 when all of the side walls are in an upright position. This construction provides interrelated lateral support for all of the side walls. The portion 76 of the tabs gives lateral support to the side walls 14, 16 while the fingers 78 give lateral support to the side walls 18, 20.

Latching means are provided to secure the side walls in the upright position. The latching means for the side walls 18, 20 comprise square pins 82 which extend through the rails at a point adjacent the lower end thereof as may be seen in FIG. 4. The pins 82 extend beyond the rails and terminate exteriorly thereof in projecting portions 84, 86. The side panels 32, 34 of the U-shaped support elements have notches 88, 90 on the upper edges thereof to receive the projecting portions 84, 86 as will be noted in FIGS. 3, 4 and 6. It is only necessary to reverse the steps shown in FIG. 6 to collapse the side walls in order to position the side walls in a secure upright position.

Figure 5:
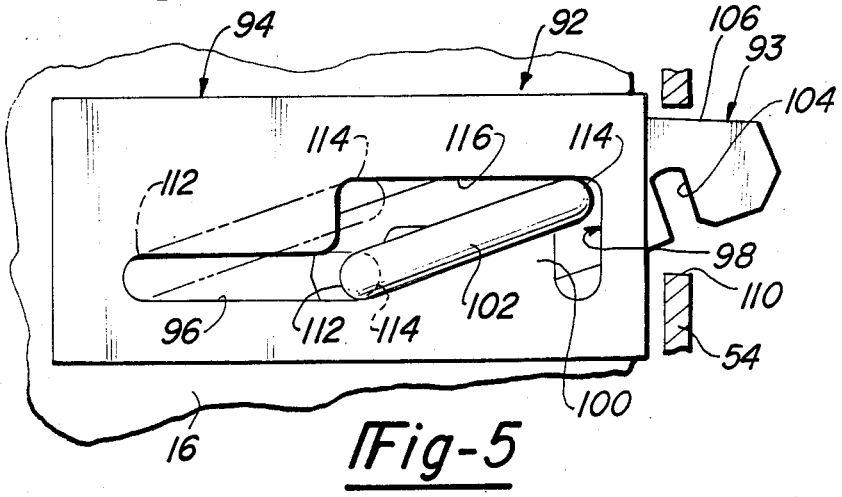
FIG. 5 is an elevational view of the slidable latch provided on two of the side walls of the bin.
Figure 7:
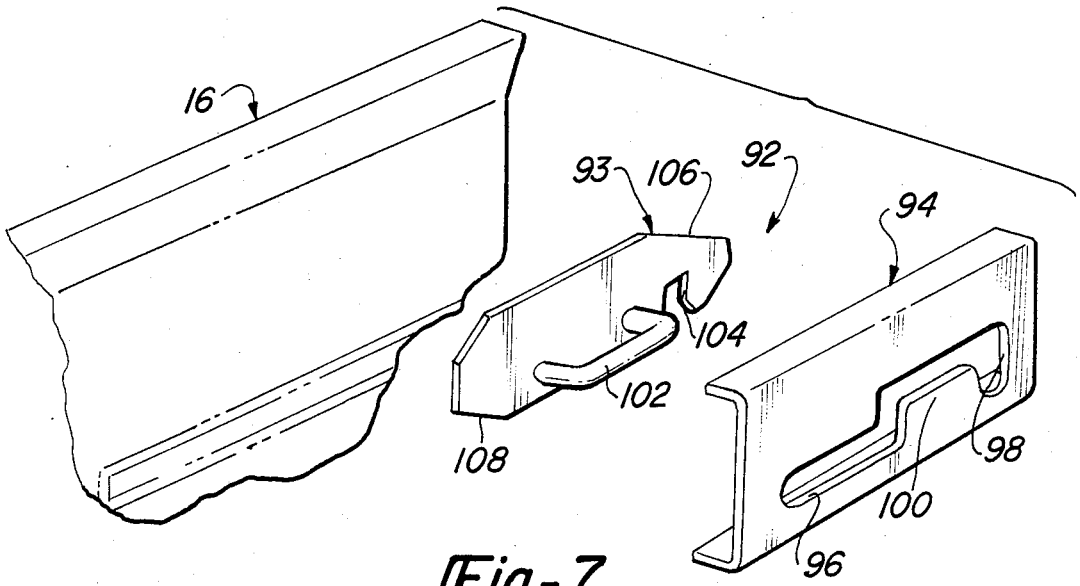
FIG. 7 is an exploded view in perspective of the slidable latch of FIG. 5.

After the side walls 18, 20 have been erected in an upright position, the other side walls 14, 16 may be lifted upwardly into position. The side walls 14, 16 are provided with a slidable latch structure 92 on each upper corner of each side wall. This latch mechanism is best shown in FIGS. 3, 5, and 7. As will be noted in FIG. 7, the latch structure comprises a slidable latch 93 which is mounted within a U-shaped casing 94. The casing 94 is secured to the side wall, representatively side wall 16, as by welding. The casing 94 is provided with a slot including a first straight portion 96 followed by a U-shaped portion 98. A tongue 100 is defined by the U-shaped portion 98. The slidable latch 93 includes a U-shaped handle 102 which is received through the slot in the casing 94. This securely mounts the latch 93 within the casing 94. The slidable latch 93 has a notch 104 on the lower edge adjacent the outer end thereof. The upper edge is angled at 106. The rear lower edge is angled at 108. A slot 110 to receive the slidable latch 93 is provided in the upper portion of each adjacent side wall rail 48, 50, 52, 54, representatively side wall rail 54, in FIG. 5.

The front of the latch 93 is shown in latching position in FIG. 3. As will be noted, the handle 102 is received over the tongue 100 to thereby secure the slidable latch 93 in place and prevent inadvertent release thereof which would permit collapsing of the side wall. When it is desired to lower the side walls 14, 16, the slidable latch is disengaged. The process for this is illustrated in FIG. 5. As will be noted, the forward end of the handle 102 is first tilted upwardly to thereby disengage the notch 104 from the adjacent side wall rail. The slidable latch is then slid leftwardly as viewed in FIG. 5 and shown in dotted lines whereupon the lower handle portion 112 will slide in the straight slot portion 96 while the upper handle portion 114 will slide in the portion 116 of the U-shaped slot 98. After handle portion 112 reaches the end of straight slot portion 96, the handle is released whereupon portion 114 will drop into the slot 96 thereby retaining the handle in place until it is desired to again latch the sidewall in an upright position. The angled portion 106 of the slidable latch 93 provides clearance for sliding the latch 93 into the casing 94. The other angled portion 108 provides clearance for tilting of the latch 93 within casing 94.

FIG. 2 illustrates the size of a bin when it is in the collapsed condition. As will be noted, portions of the U-shaped support elements 22, 24, 26, 28 extend above the collapsed side walls 18, 20. This leaves a space for reception of feet 118 provided on the underside of the bottom wall 12 at each corner thereof. As shown in FIG. 1, the feet 118 are received in the upper portion of the U-shaped support elements 22, 24, 26, 28 for stacking purposes. This permits collapsed bins 10 to be stacked one on top of the other for storage or shipment. Loaded erected bins 10 may be similarly stacked with the feet 118 being received within the upper ends of tubular rails 48, 50, 52, 54. A pair of loops 120, 122 are provided on the underside of the bottom wall 12 on each side of the bin 10 to facilitate manipulation of the bins by means of fork lift trucks.

I claim:

1. A collapsible bin comprising a generally rectangular bottom wall and four side walls, the bottom wall having an upstanding U-shaped support element at each corner thereof, each support element comprising an upstanding back panel with spaced apart upstanding side panels extending from the upstanding side panels extending from the upstanding edges thereof to define the aforesaid U-shape, each U-shaped support element having a mouth providing access to the interior thereof, the support elements being arranged in two pairs, each pair comprising a U-shaped support element on adjacent corners of the bottom wall, the mouths of the U-shaped support elments of each pair facing each other, the side walls being arranged into first and second pairs, the first pair of side walls comprising oppositely disposed side walls which face each other and each of which extends between one of the pairs of U-shaped support elements and is pivotally connected at the lower portion thereof, each side wall of the first pair adapted to be directly pivoted from an upright position to a collapsed position over the bottom wall, the second pair of side walls comprising the remaining oppositely disposed side walls which face each other and each of which extends between adjacent support elements of different pairs and is pivotally and slidably connected at the lower portion thereto, each side wall of the second pair having a downwardly extending rail at each lower corner thereof, the rails being received within the U-shaped support elements, each rail having a slot opening means therein, a pin structure secured within each of the U-shaped support elements extending into the slot opening means of each associated rail to pivotally and slidably mount the rail, said slot opening means of each rail being angled upwardly and inwardly of the bin, each side wall of the second pair adapted to be pivoted from an upright position to a collapsed position over the bottom wall by first lifting the side wall upwardly whereupon it will slide on the pin structure and move inwardly of the bin and then pivoting it to the collapsed position over the bottom wall, the inward movement of the side wall spacing the bottom of the rails from the back panel of the U-shaped support element so that the bottom of the rails will clear the back panel when the side wall is pivoted and also to space the pivot point of the side walls of the second pair above the pivot point of each side wall of the first pair permitting the side walls of the first pair to be first collapsed onto the bottom wall and the side walls of the second pair to then be collapsed onto the side walls of the first pair, first latching means to releasably secure each side wall of the second pair to the U-shaped support elements associated therewith when the side walls of the second pair are in the upright position, and second latching means to releasably secure each side wall of the first pair to the adjacent side walls of the second pair when both the side walls of the first and second pairs are in the upright position, a support platform within each U-shaped support element to receive the lower end of each rail of the side walls of the second pair when said side walls are in the upright position, the lower end of each rail being substantially flat, and an upstanding lip on the edge of the support platform closest to the mouth of the U-shaped support element to prevent movement of the lower end of the rail towards said mouth.

* * * * *